US010072363B2

(12) United States Patent
Matthies

(10) Patent No.: US 10,072,363 B2
(45) Date of Patent: Sep. 11, 2018

(54) COOLING DRUM FOR COOLING A THREAD PLUG

(71) Applicant: OERLIKON TEXTILE GMBH & CO. KG, Remscheid (DE)

(72) Inventor: Claus Matthies, Ehndorf (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 15/742,414

(22) PCT Filed: Jul. 6, 2016

(86) PCT No.: PCT/EP2016/065907
§ 371 (c)(1),
(2) Date: Jan. 5, 2018

(87) PCT Pub. No.: WO2017/009122
PCT Pub. Date: Jan. 19, 2017

(65) Prior Publication Data

US 2018/0187346 A1 Jul. 5, 2018

(30) Foreign Application Priority Data

Jul. 13, 2015 (DE) ..... 10 2015 009 040

(51) Int. Cl.
*D02J 13/00* (2006.01)
*D02G 1/12* (2006.01)

(52) U.S. Cl.
CPC ..... *D02J 13/005* (2013.01); *D02G 1/12* (2013.01)

(58) Field of Classification Search
CPC ..... D02J 13/005; D02J 13/00; D02G 1/14; D02G 1/12; D02G 1/127; D02G 1/125;
(Continued)

(56) References Cited

U.S. PATENT DOCUMENTS 1,838,200 A * 12/1931 Tomtlund ..... B65H 29/32 131/34
3,217,386 A * 11/1965 Clendening, Jr. ..... D06F 39/12 162/357

(Continued)

FOREIGN PATENT DOCUMENTS

DE 2146894 A1 3/1973
DE 19613177 A1 10/1996

OTHER PUBLICATIONS

The International Bureau of WIPO, English translation of Written Opinion for International Application No. PCT/EP2016/065907, dated Jan. 25, 2018, 8 pages, Switzerland.

(Continued)

*Primary Examiner* — Amy Vanatta
(74) *Attorney, Agent, or Firm* — Alston & Bird LLP

(57) ABSTRACT

The invention relates to a cooling drum for cooling a thread plug in texturing process. The cooling drum comprises a drivable cooling jacket, on the circumference of which at least one air-permeable guide track is designed for guiding the thread plug. A suction chamber is provided in the interior of the cooling jacket, which chamber is connected via a suction connection to a vacuum source. In this way, a stationary shielding means is provided, which is arranged between the cooling jacket and the suction chamber. In order to produce a suction flow which is as targeted as possible and affected by little loss, according to the invention, the shielding means is formed by a closed sealing jacket which is placed substantially coaxially spaced apart with the cooling jacket and has an air slot in the region of the guide track.

12 Claims, 8 Drawing Sheets

(58) Field of Classification Search
CPC .... D02G 1/161; D02G 1/205; B65H 2406/33; B65H 2406/332; B65H 2406/333; B65H 2404/10; B65H 2404/11; B65H 2404/15; B65H 2404/18; B65H 2404/40; B65H 20/12; B65H 51/02; B65H 54/707; B65H 57/04; D06B 23/02; D06B 23/025; D06B 23/028; D06C 7/00; D01H 13/28; F28D 11/02
USPC ..... 28/256, 257, 266
See application file for complete search history.

(56) References Cited

U.S. PATENT DOCUMENTS 3,816,887 A * 6/1974 Smith ..... D02G 1/122 28/256
T925,009 I4 * 8/1974 Faw et al. ..... D02G 1/12 28/256
4,077,466 A * 3/1978 Fleissner ..... D02J 13/00 165/89
4,118,843 A * 10/1978 Schippers ..... D02G 1/125 28/255
4,301,578 A * 11/1981 Dammann ..... D02G 1/205 28/256
4,450,607 A * 5/1984 Li ..... D02G 1/12 28/257
5,974,777 A * 11/1999 Davis ..... D02J 13/005 28/255
6,128,913 A * 10/2000 Dell'Acqua ..... D02G 1/205 165/50
6,585,139 B1 * 7/2003 Holtmann ..... B65H 20/12 162/306
2004/0200048 A1 * 10/2004 Hubner ..... D02G 1/12 28/263
2009/0249765 A1 * 10/2009 Stundl ..... D02G 1/12 57/246

OTHER PUBLICATIONS

International Searching Authority, International Search Report (ISR) and Written Opinion for International Application No. PCT/EP2016/065907, dated Aug. 9, 2016, 12 pages, European Patent Office, Netherlands.

* cited by examiner

COOLING DRUM FOR COOLING A THREAD PLUG

CROSS REFERENCE TO RELATED APPLICATIONS

This application is a national stage application, filed under 35 U.S.C. § 371, of International Application No. PCT/EP2016/065907, filed Jul. 6, 2016, which claims priority to German Application No. 10 2015 009 040.2, filed Jul. 13, 2015, the contents of both of which as are hereby incorporated by reference in their entirety.

BACKGROUND

Technical Field

The invention relates to a cooling drum for cooling a thread plug in a texturing process, according to the claims provided herein.

Description of Related Art

A generic cooling drum for cooling a thread plug is known from DE 196 13 177 A1.

The known cooling drum has a drivable cooling jacket which on the circumference includes a plurality of air-permeable guide tracks for receiving a plurality of thread plugs that are guided beside one another. A suction chamber which by way of the suction connector is connected to a vacuum source is configured in the interior of the cooling jacket. A shielding means in the form of an aperture which covers a part-segment of the cooling jacket in which no thread plug is guided on the circumference is disposed within the suction chamber. Additionally, for improved air guiding, the cooling jacket also has separation webs that protrude radially into the suction chamber. In operation, a vacuum is generated within the suction chamber such that ambient air from outside the cooling jacket is suctioned, said ambient air perfusing and thus cooling the thread plugs. At the same time, the vacuum of the suction chamber causes the thread plugs to not be released from the guide tracks on the circumference of the cooling jacket. At the end of the cooling procedure, the thread plug on the circumference of the cooling drum is disintegrated so as to form a thread and is drawn off of the circumference of the cooling jacket at high speed.

In the case of the known cooling drum, the separation webs within the suction chamber that revolve conjointly with the cooling jacket lead to significant air turbulences and to an undesirable drop in pressure such that relatively high vacuums have to be generated in the suction chamber in order for sufficient cooling air to be able to be suctioned for cooling the thread plugs. Moreover, segment portions of large area on the cooling jacket have to be suctioned such that a significant proportion of external air enters the suction chamber. However, the high vacuums in particular impede the disintegration of the thread plug so as to form a thread. On account of the vacuum, the filaments of the thread are urged against the guide track and in part are drawn into the perforation. This leads to high stresses on the thread and to a reduction in the crimp of the thread.

Furthermore, upon the disintegration of the thread plug the thread is drawn across part of the guide track at a high thread speed. In this situation, the vacuum within the suction chamber generates a retention force that acts on the thread and increases the contact of the thread and thus the risk of abrasion and damage to the thread.

BRIEF SUMMARY

It is therefore an object of the invention to refine a cooling drum for cooling a thread plug of the generic type in such a manner that cooling of the thread plug is possible at a relatively low vacuum within the suction chamber.

It is a further object of the invention to provide a cooling drum of the generic type in which a gentle disintegration of the thread plug so as to form a crimped thread is possible.

This object is achieved according to the invention in that the shielding means is formed by a closed sealing jacket which is assigned to the cooling jacket at a spacing therefrom so as to be substantially coaxial with the latter, said sealing jacket having an air slot in the region of the guide track.

Advantageous refinements of the invention are defined by the features and by the combinations of features of the dependent claims.

The invention has the particular advantage that the suction losses are minimized. A suction flow is thus only generated in the guiding region of the thread plug on the circumference of the cooling jacket. The suction chamber to this end is connected directly to the guide track on the circumference of the cooling jacket by way of an air slot within the sealing jacket. All remaining regions are shielded by the sealing jacket. To this extent, the cooling drum according to the invention is particularly suitable for enabling a thread plug to be cooled with a low input of energy.

Depending on the process and on the thread count it is usual for the cooling distance of the thread plug to be limited to a part-wrapping on the circumference of the cooling jacket. It is provided to this end that the air slot extends over a part-circumference of the sealing jacket. The angular range of the air slot on the circumference of the sealing jacket herein can be tuned to a wrapped region of the thread plug on the circumference of the cooling jacket in such a manner that a vacuum effect is no longer generated at a disintegration point of the thread plug on the guide track, for example.

In principle however, processes in which the thread plugs are guidable on the circumference of the cooling jacket by way of a plurality of wrappings are also possible. In this case, the refinement of the invention in which the air slot is configured in a helical manner on the circumference of the sealing jacket is provided. Comparatively large wrappings of a thread plug on the circumference of the cooling jacket can thus also be readily suctioned by an air slot of the sealing jacket.

In particular in order for the disintegration of the thread plug not to be impeded, the refinement of the invention in which at least one sealing strip which in relation to the cooling jacket forms a sealing gap and is assigned to one end of the air slot is disposed on the circumference of the sealing jacket is preferably embodied. A positioning and a separation of a suction zone that acts on the guide track are thus possible. It is avoided, on account of the sealing strip between the sealing jacket and the cooling jacket, that the vacuum is propagated in an annular space formed between the cooling jacket and the sealing jacket.

In the case of a part-wrapping of the thread plug on the circumference of the cooling jacket, a second sealing strip is preferably provided on the circumference of the sealing jacket, said second sealing strip, conjointly with the sealing strip that is disposed at the opposite end, forming a suction zone in the form of annular segments between the cooling jacket and the sealing jacket. There is thus the potential for the run-on of a thread plug as well as the disintegration of the thread plug to be performed in a particularly gentle manner.

In order for potential dimensional deviations in the annular gap between the cooling jacket and the sealing jacket to be able to be compensated for, it is furthermore provided that the sealing strips are configured so as to be radially elastic. There thus remains a high sealing effect in relation to the vacuum-free zones of the cooling jacket.

A further variant of the cooling drum according to the invention in which the cooling jacket on an internal side has two sealing rings which therebetween enclose the guide track and which in each case by way of a lip seal bear on the circumference of the sealing jacket is particularly advantageous for improved sealing. The end sides of the annular suction zone between the cooling jacket and the sealing jacket can thus be advantageously sealed. It is thus avoided in particular that external air is suctioned from the environment.

In order for an intensive cooling-airflow for cooling the thread plug to be generated, the refinement of the invention in which the guide track on the circumference of the cooling jacket is formed by an encircling perforated metal sheet between two spacers has proved successful, wherein the cooling jacket below the perforated metal sheet has a perforation row of jacket openings. The effect of the vacuum across the cross-sectional areas of the perforation in the cooling jacket can thus be guided directly up to the lower side of the perforated metal sheet such that the cooling air is suctioned through the perforated metal sheet. The perforated metal sheet herein has a fine porosity in order to impede the ingress of filaments.

The disintegration of the thread plug at a disintegration point on the circumference of the cooling jacket can in particular be improved by way of the refinement according to the invention in which a compressed-air duct which is connected to the guide track by way of at least one blower opening and which is connectable to a compressed-air source is configured on an internal side of the sealing jacket. In particular, the release of the thread from the guide track on the circumference of the cooling drum can be thus facilitated. Damages to the thread and any potential wear on the guide track are completely avoided.

In order for a plurality of thread plugs to be simultaneously cooled, the refinement of the invention in which the cooling jacket has a plurality of air-permeable guide tracks that are configured so as to be beside one another in parallel is provided, wherein one of a plurality of air slots is configured per guide track on the sealing jacket.

Driving the cooling jacket is preferably performed by way of a driven drive shaft which by way of an external end wall is connected to the cooling jacket. The driveshaft herein penetrates a hollow support on which the sealing jacket is disposed by way of an internal end wall. To this extent, an intensive encapsulation of the suction chamber can be implemented by way of the sealing jacket within the cooling jacket.

The suction connector herein is preferably configured so as to be opposite the internal end wall such that the suction chamber is substantially delimited by the sealing jacket and by the internal end wall.

The cooling drum according to the invention will be explained in more detail hereunder by means of a few exemplary embodiments with reference to the appended figures.

DETAILED DESCRIPTION OF VARIOUS EMBODIMENTS

Figure 1:
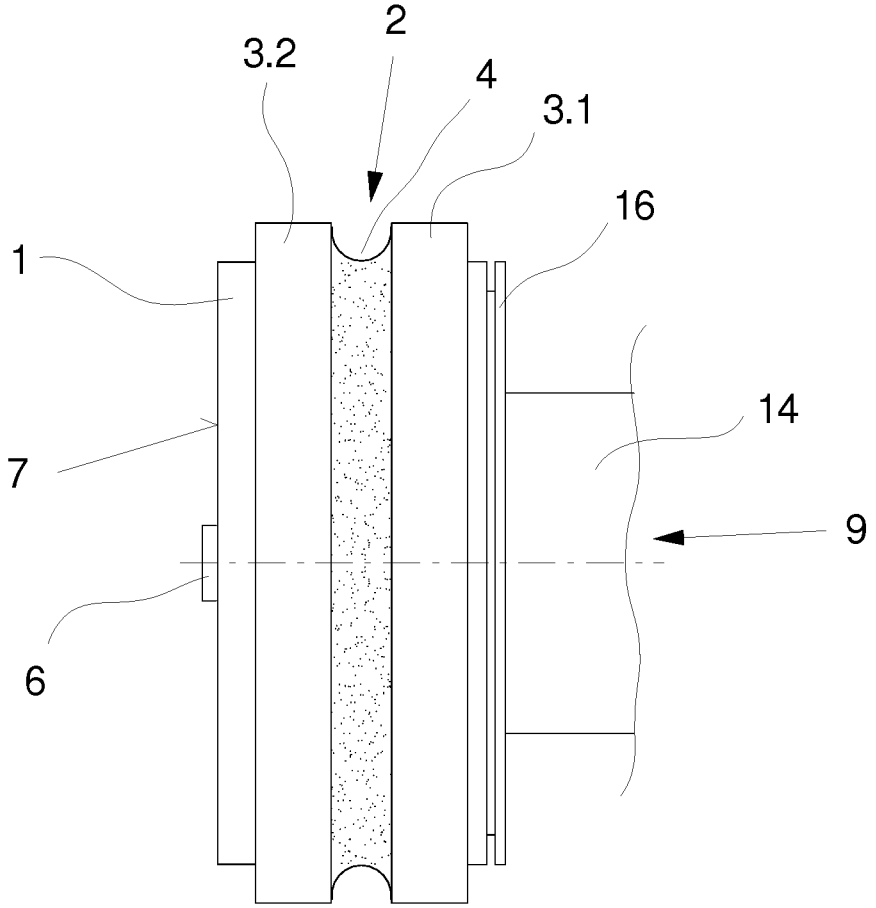
FIG. 1 schematically shows a side view of a first exemplary embodiment of the cooling drum according to the invention.
Figure 2:
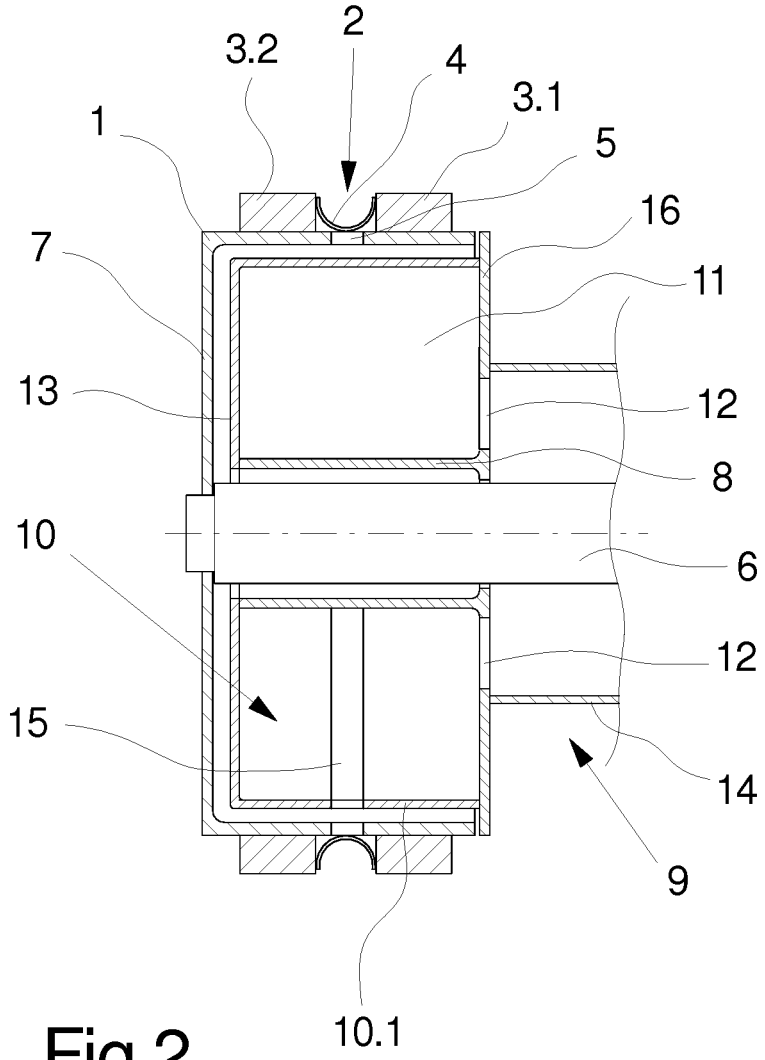
FIG. 2 schematically shows sectional longitudinal view of the exemplary embodiment from FIG. 1.
Figure 3:
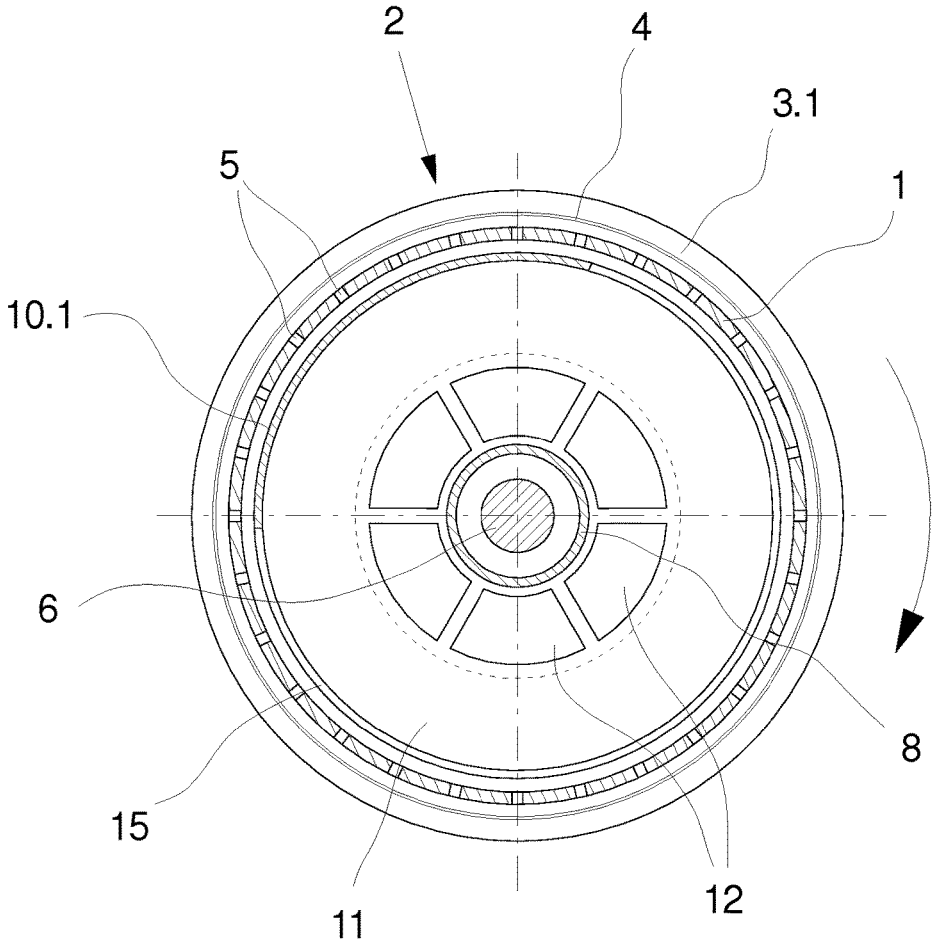
FIG. 3 schematically shows a cross-sectional view of the exemplary embodiment from FIG. 1.

A first exemplary embodiment of the cooling drum according to the invention is illustrated in a plurality of views in FIGS. 1, 2 and 3. FIG. 1 shows a side view, FIG. 2 shows a sectional longitudinal view, and FIG. 3 shows a cross-sectional view of the exemplary embodiment. In as far as no explicit reference is made to any one of the figures the description hereunder applies to all figures.

The exemplary embodiment of the cooling drum according to the invention has an annular cooling jacket 1. A guide track 2 for receiving a thread plug is configured on the circumference of the cooling jacket 1. The guide track 2 in this exemplary embodiment is formed by a perforated curved metal sheet 4 which is disposed between two spacers 3.1 and 3.2. The spacers 3.1 and 3.2 are fixedly connected to the circumference of the cooling jacket 1. The perforated metal sheet 4, having a multiplicity of smallest openings, is configured so as to be air-permeable. The cooling jacket 1 below the perforated metal sheet 4 has a plurality of jacket openings 5 which enclose the cooling jacket 1 as a perforation row.

As can be derived in particular from the illustrations in FIGS. 2 and 3, a suction chamber 11 is configured in the interior of the cooling jacket 1. The suction chamber 11 is separated from the cooling jacket 1 and from an external end wall 7 by way of a shielding means 10. The shielding means 10 in this exemplary embodiment is formed by an annular closed sealing jacket 10.1 which is held by way of an internal end wall 13 that is disposed laterally to the sealing jacket 10.1. The closed internal end wall 13 is disposed in a protruding hollow support 8 and extends so as to be parallel with the external end wall 7. The hollow support 8 therein is penetrated by the driveshaft 6.

An air slot 15 is configured on the sealing jacket 10.1 in the plane of the guide track 2. The air slot 15 extends across a part-circumference of the sealing jacket 10.1. The length of the air slot 15 is chosen so as to depend on the wrapping of the plug of the thread plug that is required for cooling and disintegrating the thread. The part-wrapping of the thread plug herein is <360°.

As can be derived in particular from the illustration in FIG. 2, the internal suction chamber 11 is delimited by a dish-shaped collar 16 of the hollow support 8. A suction connector 9 which in this exemplary embodiment is formed by a suction port 14 adjoins the collar 16. The suction port 14 to this end is connected to the hollow support 8. A plurality of suction openings 12 within the suction port 14 are configured on the collar 16 of the hollow support 8. The suction openings 12 are opposite the internal end wall 13.

In operation, the cooling jacket 1 is rotatingly driven by way of the driveshaft 6. Therein, a thread plug that has been produced in a texturing process is received on the circumference of the cooling jacket 1 within the guide track 2 and is guided on the cooling jacket 1 by way of a part-wrapping. The suction chamber 11 that is configured in the interior of the sealing jacket 10.1 by way of the suction openings 12 and by way of the suction port 14 is connected to a vacuum source. To this extent a vacuum is generated in the suction chamber 11. The vacuum in the suction chamber 11 causes a suction flow on the air slot 15, said suction flow acting on the guide track 2. On account thereof, cooling air is suctioned from the environment by way of the guide track 2 and by way of the air slot 15 into the suction chamber 11 and is discharged by way of the suction port 14. The ambient air herein penetrates the thread plug that bears on the circumference of the perforated metal sheet 4 and penetrates the cooling jacket 1 by way of the jacket openings 5 toward the air slot 15. To this extent, a targeted airflow is generated only in the region of the guide track 2. In the case of conventional processes, sufficient cooling flows on the guide track 2 can already be generated by way of low vacuums.

The relationship between the perforated metal sheet 4 and the jacket openings 5 and the air slot 15 herein can be optimized in terms of aerodynamics. The opening cross sections as well as the mutual spacings can thus be varied. The perforated metal sheet 4 typically has a larger opening cross section than the jacket openings 5, and the jacket openings 5 typically have a larger opening cross section than the air slot 15.

Figure 4:
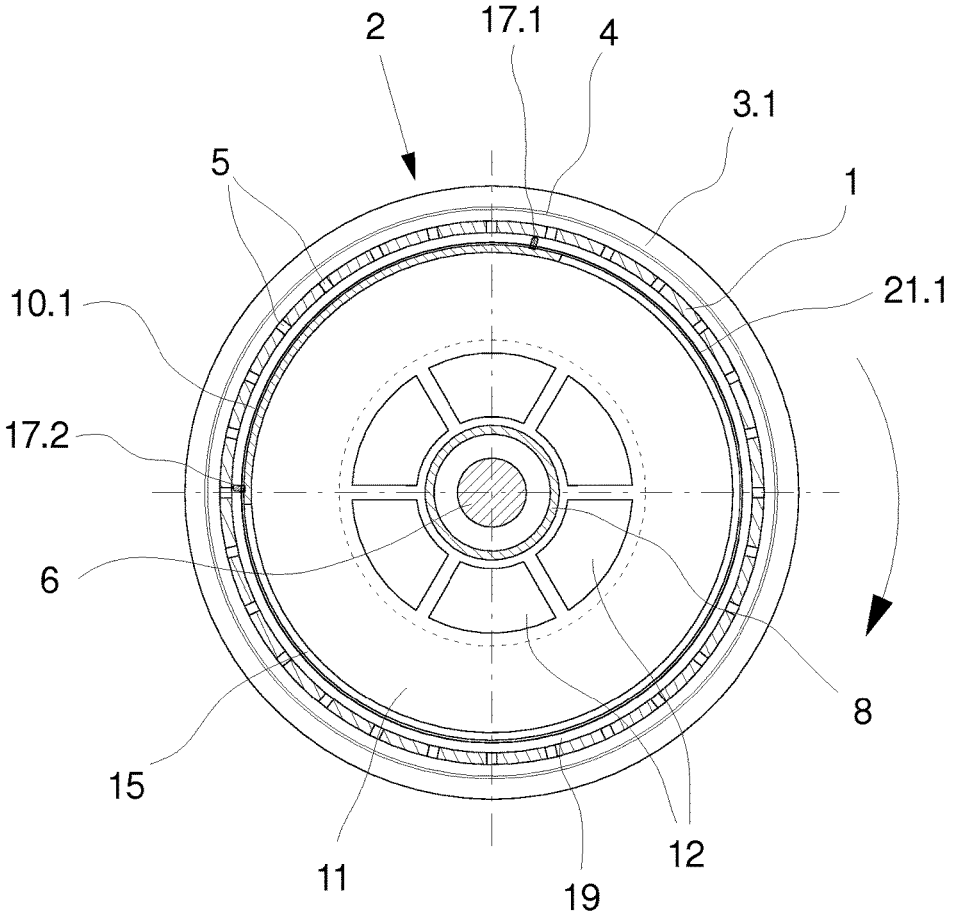
FIG. 4 schematically shows a cross-sectional view of a further exemplary embodiment of the cooling drum according to the invention.
Figure 5:
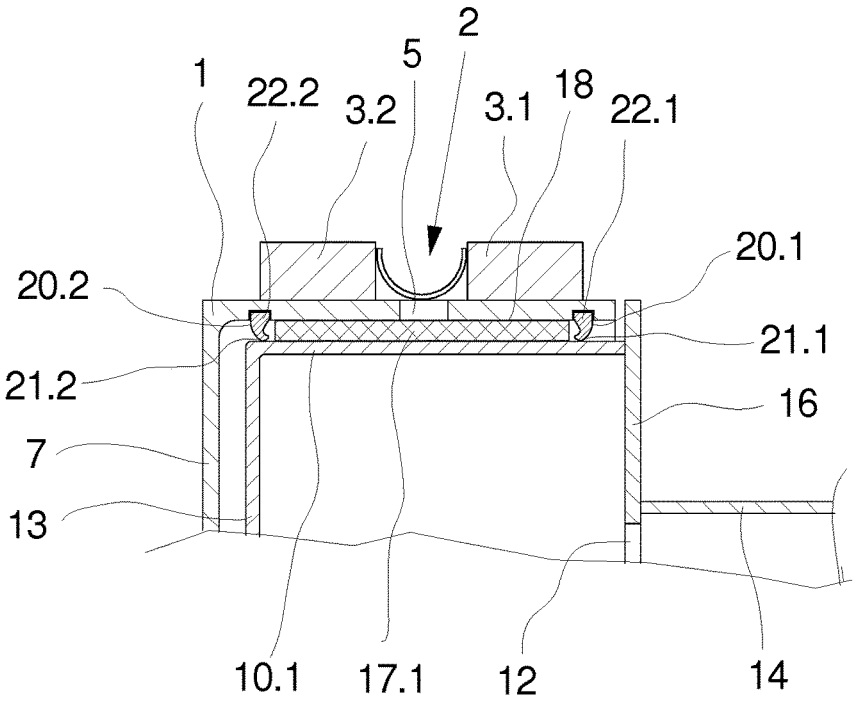
FIG. 5 schematically shows a fragment of a sectional longitudinal view of the exemplary embodiment from FIG. 4.

In order for as little external air as possible to be suctioned in order to avoid leakage flows as far as possible, a further exemplary embodiment of a cooling drum according to the invention is illustrated in FIGS. 4 and 5. A cross-sectional view is schematically shown in FIG. 4, and a fragment of a sectional longitudinal view is schematically shown in FIG. 5.

The exemplary embodiment as per FIGS. 4 and 5 is substantially identical to the exemplary embodiment as per FIGS. 1 to 3 such that only the points of differentiation are mentioned at this stage in order for repetitions to be avoided.

In the case of the exemplary embodiment illustrated in FIGS. 4 and 5, two sealing strips 17.1 and 17.2 are assigned to the ends of the air slot 15. The sealing strips 17.1 and 17.2 are disposed on the circumference of the sealing jacket 10.1 and in relation to the cooling jacket 1 form a sealing gap 18. The sealing strips 17.1 and 17.2 are embodied so as to be elastic so as to be able to compensate for potential deviations in tolerances in the gap between the sealing jacket 10 and the cooling jacket 1 when the cooling jacket 1 rotates. The sealing strips 17.1 and 17.2 are axially aligned and enclose an annular suction zone 19 on the circumference of the sealing jacket 10.1.

As can be derived in particular from the illustration in FIG. 5, the sealing strips 17.1 and 17.2 extend substantially across the entire width of the sealing jacket 10.1. Since the sealing strips 17.1 and 17.2 are of identical configuration only the sealing strip 17.1 is illustrated in FIG. 5.

In order for the suction zone that is formed between the sealing strips 17.1 and 17.2 to be sealed at the end side, the cooling jacket 1 at the ends thereof has in each case one groove 22.1 and 22.2 in which in each case one sealing ring 20.1 and 20.2 is held. The sealing rings 20.1 and 20.2 at a free and protruding end have a lip seal 21.1 and 21.2 which is in frictional contact with the circumference of the sealing jacket 10.1. To this extent, a closed suction zone 19 results in the transition region between the sealing jacket 10.1 and the cooling jacket 1 below the guide track 2. A highly targeted generation of cooling air without any substantial losses is thus possible. To this extent, the exemplary embodiment illustrated in FIGS. 4 and 5 is particularly energy-saving and at relatively low vacuums enables intensive cooling of a thread plug that is guided on the circumference of the guide track 2.

Quasi a closed space in relation to the suction chamber 11 or to the environment, respectively, is formed on account of the radial seals 22.1 and 22.2 and of the sealing strips 17.1 and 17.2. This space could thus have a positive pressure in relation to the environment so as to obtain a flow of blown air in the disintegration region on the circumference of the guide track 2 in order for the thread to be released in an improved manner. However, the space could also have a negative pressure in relation to the environment so as to cause a flow of suctioned air.

The length of the air slot on the part-circumference of the sealing jacket 10.1 and the arrangement of the sealing strips 17.1 and 17.2 is chosen in such a manner that the entry of the thread plug in the angular range of the sealing strip 17.1 is repositioned, for example. The sealing strip 17.2 that follows in the running direction of the cooling jacket 1 (identified by an arrow) represents that region in which a disintegration of the thread plug and a drawing-off of the thread on the circumference of the cooling jacket is performed. In particular the disintegration and the drawing-off of the thread herein can be located in a non-suctioned zone of the cooling jacket 1.

Figure 6:
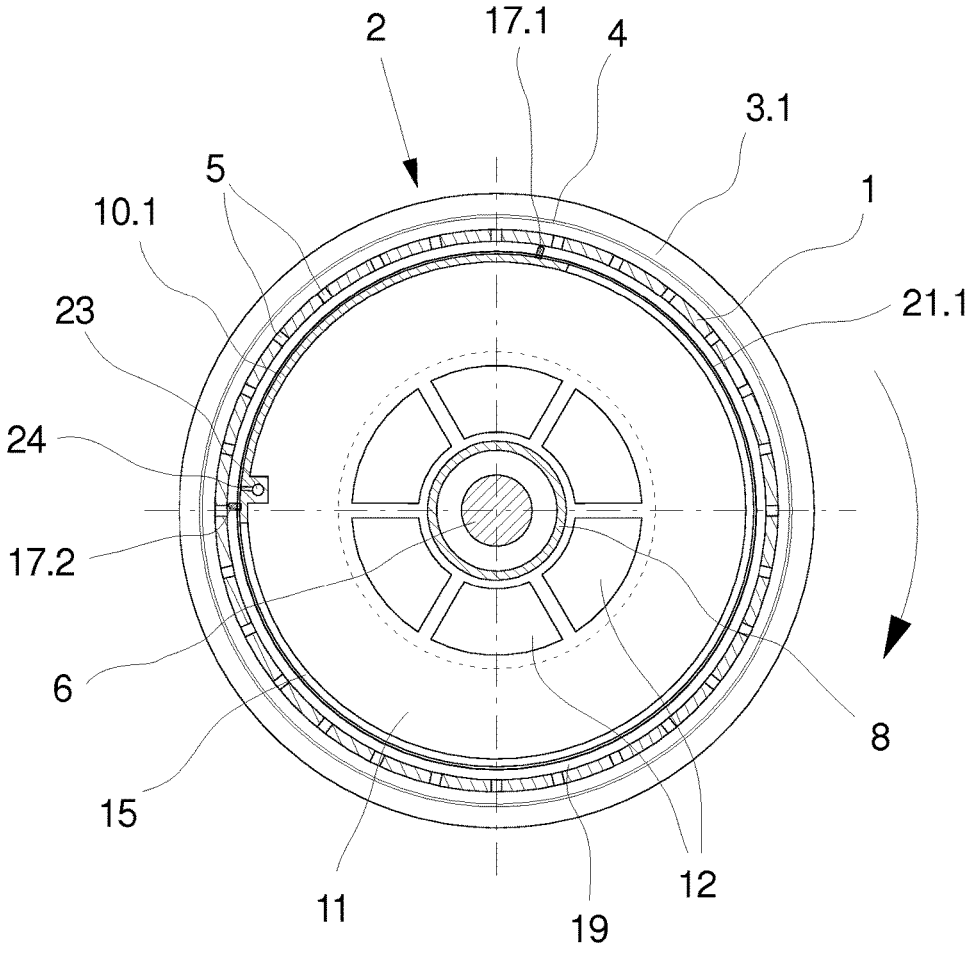
FIG. 6 schematically shows a cross-sectional view of a further exemplary embodiment of the cooling drum according to the invention.
Figure 7:
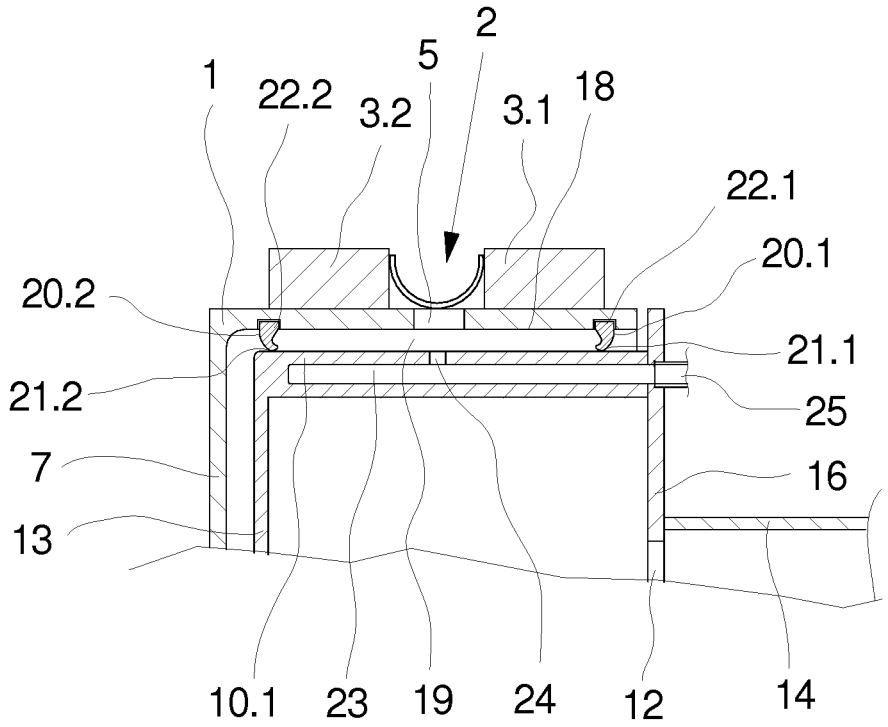
FIG. 7 schematically shows a fragment of a sectional longitudinal view of the exemplary embodiment from FIG. 6.

In order for the run-out of the thread out of the guide track 2 to be facilitated, a further exemplary embodiment of the cooling device according to the invention is illustrated in FIGS. 6 and 7. FIG. 6 schematically shows a cross-sectional view, and FIG. 7 schematically shows a fragment of a sectional longitudinal view. The exemplary embodiment as per FIGS. 6 and 7 is substantially identical to the exemplary embodiment as per FIGS. 4 and 5 such that only the points of differentiation will be explained hereunder.

In the case of the exemplary embodiment of the cooling drum according to the invention illustrated in FIGS. 6 and 7 a compressed-air duct 23 which is connected to the guide track 2 by way of a blower opening 24 is configured within the cooling jacket 1. The compressed-air duct 23 by way of a compressed-air connector 25 that is configured on the collar 16 is connectable to a compressed-air source (not illustrated here).

As can be derived from the illustration in FIG. 6, the compressed-air duct 23 is disposed on the sealing jacket 10.1 in an angular position in which a thread is released and drawn off from the thread plug. To this extent, the release of the thread from the guide track 2 in operation is supported by way of a slight flow of blown air which by way of the blower opening 24 and by way of the jacket opening impacts the perforated metal sheet 4. To this extent, frictional contact of threads and catching of filaments on the porous perforated metal sheet 4 can be avoided.

Practically, it is also usual for a plurality of thread plugs to be simultaneously cooled in parallel on the circumference of a cooling drum. The cooling drum according to the invention is particularly suitable for cooling a plurality of thread plugs, as can be derived from the illustration of a further exemplary embodiment as per FIG. 8. In the case of the exemplary embodiment illustrated in FIG. 8 one image half is illustrated as a side view, and a second image half is illustrated as a sectional longitudinal view. Since the exemplary embodiment in terms of the basic construction is identical to the exemplary embodiments as per FIGS. 1 to 6, the components with identical functions are provided with identical reference signs.

A cooling jacket 1 is connected to a drive shaft 6 by way of an external end wall 7. A plurality of encircling guide tracks 2 are configured so as to be parallel beside one another on the circumference of the cooling jacket 1. The guide tracks 2 are formed by a plurality of spacers 3.1 to 3.4 and by a plurality of perforated metal sheet 4. The perforated metal sheet 4 is embodied in a U-shape and has a multiplicity of finest perforations. A perforation row 5 of a plurality of jacket openings 5 is assigned to each of the perforated sheet-metal plates 4 in the cooling jacket 1.

An annular sealing jacket 10.1 which at the height of the guide tracks 2 has in each case one of a plurality of air slots 15 is provided within the cooling jacket 1. One air slot 15 is thus assigned to each guide track 2 on the circumference of the cooling jacket 1.

The sealing jacket 10.1 by way of an internal end wall 13 is fixedly connected to a stationary hollow support 8. The hollow support 8 on that collar side on the collar 16 that is opposite the internal end wall 13 has a plurality of suction openings 12 which by way of a suction port 14 are connected to a vacuum source (not illustrated here).

Figure 8:
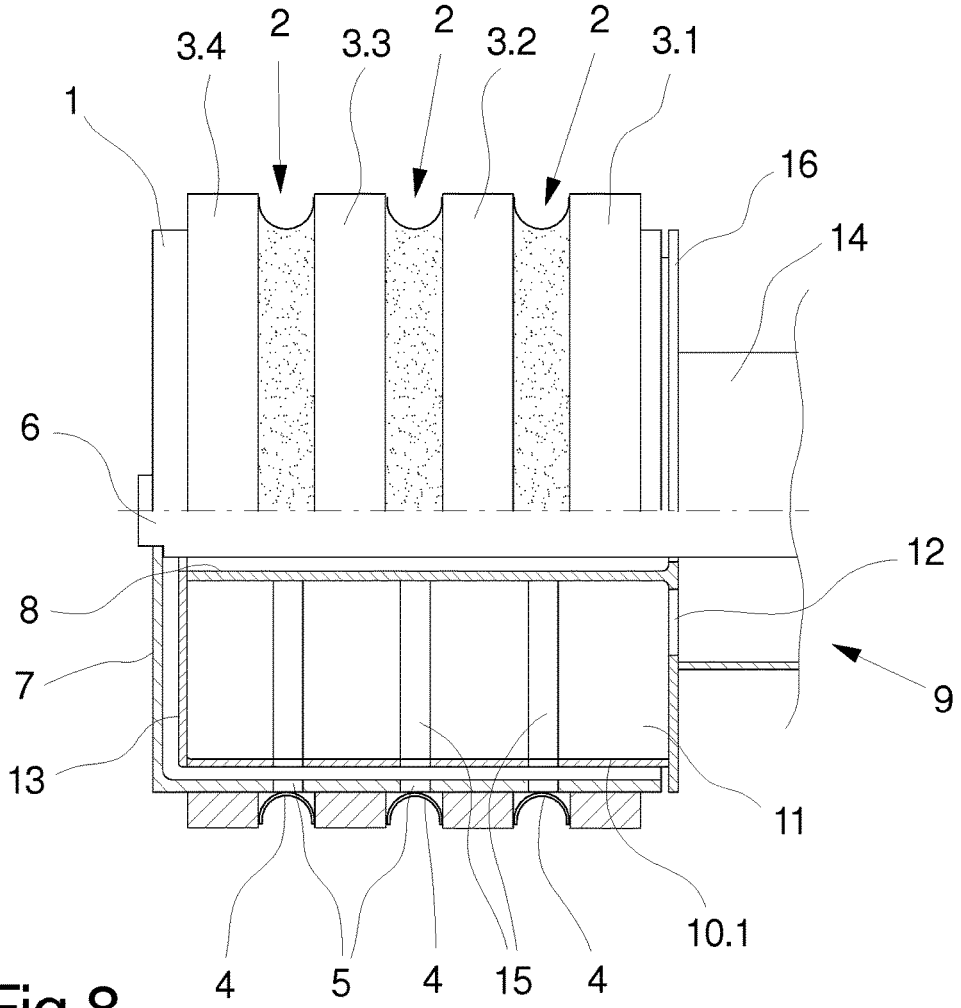
FIG. 8 schematically shows a side view of a further exemplary embodiment of the cooling drum according to the invention.

In the case of the exemplary embodiment of the cooling drum according to the invention illustrated in FIG. 8 a plurality of thread plugs can thus be simultaneously guided and cooled by way of a part-wrapping on the circumference of the cooling jacket.

In principle however, there is also the possibility for guiding a thread plug on a cooling drum by way of a multiple wrapping. The cooling drum according to the invention is also positively suitable for this purpose.

The exemplary embodiments of the cooling drum according to the invention illustrated in FIGS. 1 to 8 in terms of the structure and the construction of the individual parts are exemplary. In principle, similar constructions can be chosen in order for a targeted suction flow to be generated by way of air slots of a sealing jacket. The exemplary embodiments by way of the features thereof can thus also be combined in an arbitrary manner so as to obtain new variants of embodiment.

The invention is distinguished by a particularly gentle treatment of the threads. The installation size and the discharge ducts of the suction air can be reduced in size by virtue of lower vacuums.

The invention claimed is:

1. Cooling drum for cooling a thread plug in a texturing process, the cooling drum comprising:

a drivable cooling jacket (1), at least one air-permeable guide track (2) for guiding the thread plug, the at least one guide track (2) being positioned on a circumference of said cooling jacket (1), a suction chamber (11) positioned in an interior of the cooling jacket (1) and that is connected to a suction connector (9) and to a stationary shielding means (10) which shields the suction chamber (11) from the cooling jacket (1), wherein:

the shielding means (10) is a closed sealing jacket (10.1) positioned substantially coaxial with and spaced from the cooling jacket (1), and an air slot (15) is positioned on the sealing jacket (10.1) in a plane of the guide track (2).

2. Cooling drum as claimed in claim 1, wherein the air slot (15) extends over a part-circumference of the closed sealing jacket (10.1).

3. Cooling drum as claimed in claim 1, wherein the air slot (15) is configured in a helical manner on a circumference of the closed sealing jacket (10.1).

4. Cooling drum as claimed in claim 1, wherein at least one sealing strip (17.1, 17.2) defines a sealing gap (18) in relation to the cooling jacket (1), the at least one sealing strip (17.1, 17.2) being positioned adjacent one end of the air slot (15) and disposed on a circumference of the closed sealing jacket (10.1).

5. Cooling drum as claimed in claim 4, wherein:

the at least one sealing strip (17.1, 17.2) comprises a plurality of sealing strips (17.1, 17.2);

a suction zone (19), in the form of annular segments, is defined by one of the plurality of sealing strips, (17.1, 17.2) on the circumference of the closed sealing jacket (10.1) between the cooling jacket (1) and the closed sealing jacket (10.1), and the air slot (15) extends within the suction zone (19).

6. Cooling drum as claimed in claim 4, wherein the at least one sealing strip (17.1, 17.2) is configured so as to be radially elastic.

7. Cooling drum as claimed in claim 1, wherein:

the cooling jacket (1) on an internal side has two sealing rings (20.1, 20.2) which therebetween enclose the guide track (2); and each of the two sealing rings (20.1, 20.2), by way of a lip seal (21.1, 21.2), bear on a circumference of the closed sealing jacket (10.1).

8. Cooling drum as claimed in claim 1, wherein:

the at least one guide track (2) on the circumference of the cooling jacket (1) is formed by an encircling perforated metal sheet (4) between two spacers (3.1, 3.2), and the cooling jacket (1) below the perforated metal sheet (4) has a perforation row of jacket openings (5).

9. Cooling drum as claimed in claim 1, wherein a compressed-air duct (23) is connected to the at least one guide track (2) by way of at least one blower opening (24) and is connectable to a compressed-air source located on an internal side of the closed sealing jacket (10.1).

10. Cooling drum as claimed in claim 1, wherein:

the cooling jacket (1) has a plurality of air-permeable guide tracks (2) that are configured so as to be beside one another in parallel, and one of a plurality of air slots (15) is configured per guide track (2) on the closed sealing jacket (10.1).

11. Cooling drum as claimed in claim 1, wherein:

the cooling jacket (1) is connected to a drive shaft (6) by way of an external end wall (7), and the closed sealing jacket (10.1) by way of an internal end wall (13) is fastened to a hollow support (8), wherein the drive shaft (6) penetrates the hollow support (8).

12. Cooling drum as claimed in claim 11, wherein:

the suction connector (9) is configured so as to be opposite the internal end wall (13); and the suction chamber (11) is connectable to a vacuum source via the suction connector (9).

* * * * *